United States Patent [19]

Murphey

[11] 4,174,742

[45] Nov. 20, 1979

[54] METHOD AND APPARATUS FOR MAKING AND DISPENSING SNOW CONES

[76] Inventor: James D. Murphey, 2438 W. Butler, Phoenix, Ariz. 85021

[21] Appl. No.: 875,982

[22] Filed: Feb. 8, 1978

[51] Int. Cl.[2] ..... B65B 1/04; B65B 43/42

[52] U.S. Cl. ..... 141/11; 141/87; 141/90; 141/104; 141/174; 221/210; 425/195

[58] Field of Search ..... 53/36, 239; 141/1, 11, 141/69, 71, 73, 80, 82, 86, 87, 89–91, 100, 104, 105, 107, 115, 165, 168, 173, 174, 175, 198, 311 A, 351, 359, 369, 379; 221/96, 210, 220, 260; 425/185, 195, DIG. 201

[56] References Cited

U.S. PATENT DOCUMENTS

| | | | |
|---|---|---|---|
| 1,907,900 | 5/1933 | Tevander | 221/210 X |
| 2,984,059 | 5/1961 | Hollingsworth | 141/174 X |

*Primary Examiner*—Richard E. Aegerter
*Assistant Examiner*—Frederick R. Schmidt
*Attorney, Agent, or Firm*—Herbert E. Haynes, Jr.

[57] ABSTRACT

A coin operated vending machine for automatically making and dispensing snow cones in accordance with a method of sequentially activating a cup delivery mechanism, depositing flaked ice from a self-contained ice making machine into the cup through an ice retainer collar, activating an ice capping device, depositing a selected flavoring syrup onto the capped ice, and dispensing the finished snow cone and readying the machine to repeat the sequence upon deposition of another coin.

18 Claims, 17 Drawing Figures

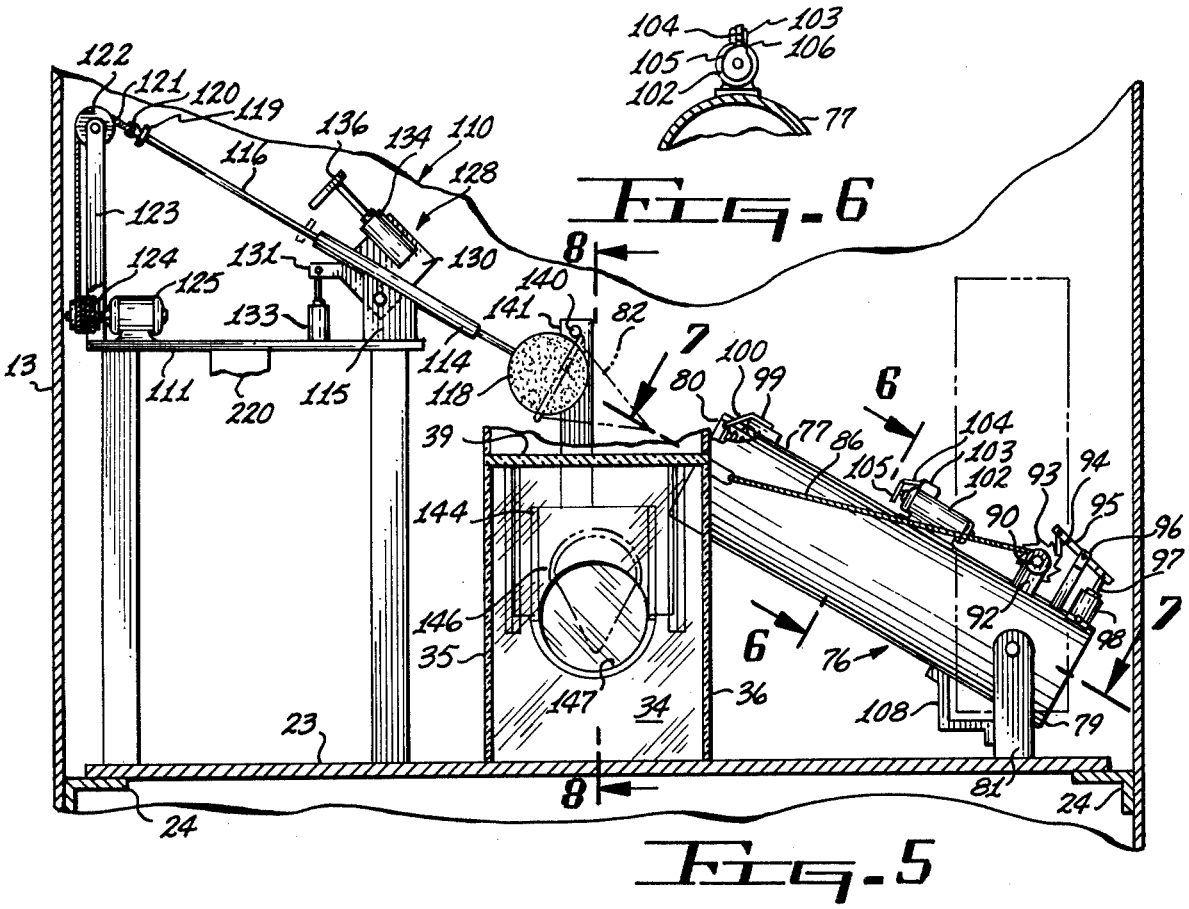
Fig-6
Fig-5
Fig-7
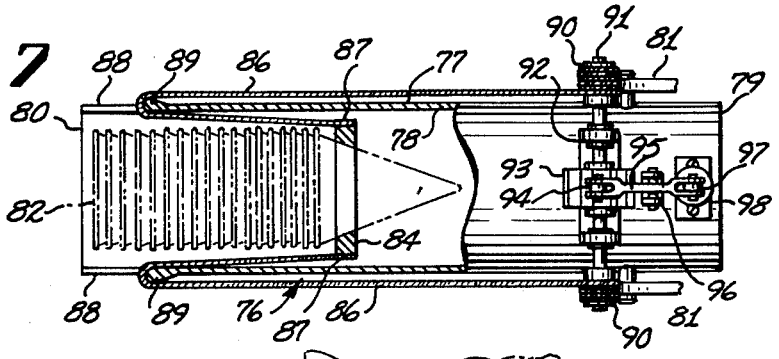
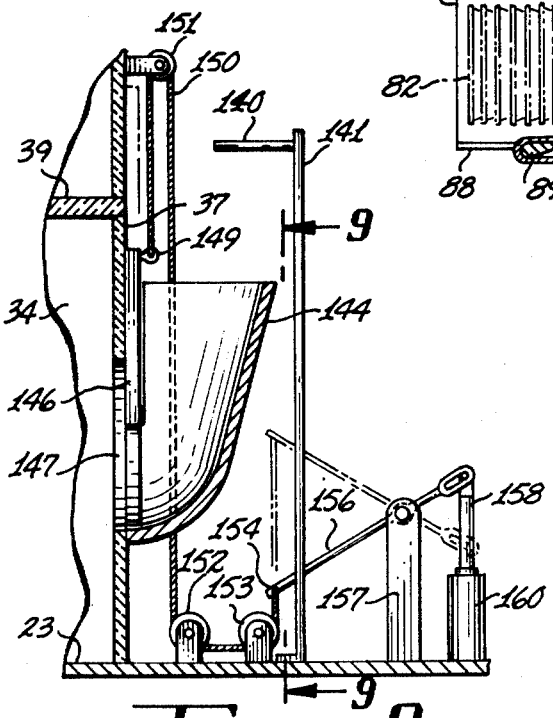
Fig-8
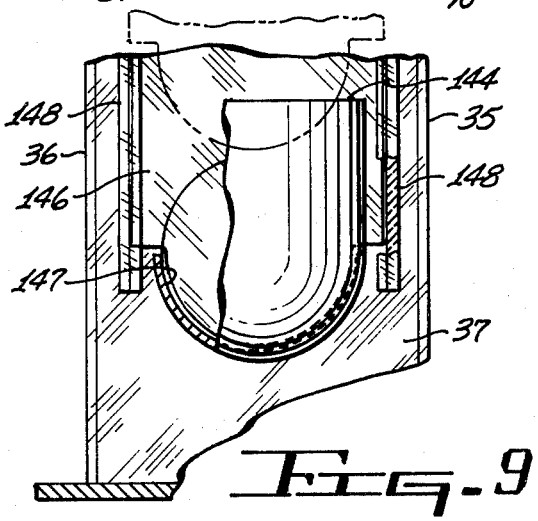
Fig-9

METHOD AND APPARATUS FOR MAKING AND DISPENSING SNOW CONES

BACKGROUND OF THE INVENTION

1. Field of the Invention

This invention relates generally to a method and apparatus for making cold confectionery products, and more particularly to a method and coin operated machine for automatically making and dispensing snow cones.

2. Description of the Prior Art

Snow cones are a unique confection which is very popular and appealing particularly to youths. The snow cone has stood the test of time despite some inherent problems associated with the making and dispensing thereof.

As is well known, snow cones are made by depositing flaked ice into a cone shaped cup and applying a flavoring syrup thereon. The nature of the flaked ice and the syrup itself makes it impractical to make and store the snow cones for subsequent use as is done with other popular confectionery products such as ice cream and soft drinks. In the first place, prolonged standing of a snow cone will allow the flavoring syrup to drain through the flaked ice into the bottom of the cup with only traces of the syrup remaining in the ice at the top of the cone. When the snow cone is left standing in an unrefrigerated environment, the ice itself, due its nature, will melt relatively rapidly. Additionally, the flaked ice used in making the snow cones is not conducive to cold storage of the product in that the ice will become a fused mass and thus change the entire characteristics of the product.

Due to the above described inherent problems of making and dispensing snow cones, they are limited to a marketing concept which relegates that the cones be made and dispensed on a demand basis, i.e., a customer orders a snow cone and an attendant manually makes and dispenses the ordered cone. Such limitations have seriously curtailed the marketing of this product in that snow cones are usually found only at special locations and at special events such as at some specialty stores, state fairs, sports arenas and the like. Even at such specialty locations, the profit margin is relatively low due to the need for an attendant, and the making and dispensing of snow cones is such a slow process that many purchasers become discouraged in long waiting lines.

The machines currently being used for making snow cones consist more or less of a grinding machine for making the flaked ice, and the other operations such as depositing the ice into a cup and applying the flavored syrup are manually accomplished by an attendant. Depending on the attendant, the environment, and the equipment used, such a manual operation can be very unsanitary.

Therefore, it would be advantageous to provide a new and improved method and apparatus for automatically making and dispensing snow cones.

SUMMARY OF THE INVENTION

In accordance with the present invention, a new and useful method and apparatus for making and dispensing snow cones is disclosed.

The apparatus of the present invention is a coin operated vending machine which in response to the deposition of a coin, will automatically sequentially activate a cup dispensing device which moves a cup from a supply storage location into a preparation and dispensing compartment, and then delivers flaked ice from a self-contained automatic ice making machine through a reciprocally operable ice retaining collar, and then actuates a reciprocally operated capper mechanism which shapes the ice into a capped hemispherical dome atop the cup. When those operations have been completed, a consumer selected flavored syrup is delivered from a syrup reservoir to the snow cone preparation and dispensing compartment and is deposited atop the ice dome by a syrup delivery mechanism. The completed snow cone is then dispensed and the machine automatically readies itself for repeating the operational sequence upon deposition of the next coin.

The method of the present invention includes the steps of: delivering a snow cone cup to a cup retaining device, placing an upstanding collar about the rim of the snow cone cup, depositing flaked ice in the cup and in the collar, forming the deposited ice into a hemispherical dome atop the cup, removing the collar, and applying a flavored syrup atop the ice dome on the cup to complete making of the snow cone.

Accordingly, it is an object of the present invention to provide a new and improved apparatus for making and dispensing snow cones.

Another object of the present invention is to provide a new and improved self-contained vending machine for automatically making and dispensing snow cones upon command of a consumer.

Another object of the present invention is to provide a new and improved apparatus of the above described character which will automatically make snow cones in a sanitary environment and in an expeditious manner.

Another object of the present invention is to provide a new and improved machine of the above described character which contains specialized devices and mechanisms for making and delivering ice in flaked form, delivering cups to a dispensing compartment and stabilizing the cups therein, devices for receiving and shaping the ice and a mechanism for delivering and applying a selected flavored syrup to the ice within the cup.

Another object of the present invention is to provide a new and improved method for making snow cones.

Still another object of the present invention is to provide a new and improved method for making snow cones which includes the steps of: delivering a snow cone cup to a cup retaining structure, placing an upstanding ice retaining collar about the rim of the cup, depositing flaked ice in the cup and in the upstanding collar, shaping the ice into a hemispherical dome shape atop the cup, retracting the upstanding collar, and applying a selected flavored syryp to the ice dome on the cup.

The foregoing and other objects of the present invention, as well as the invention itself, will be more fully understood from the following description when read in conjunction with the accompanying drawings.

BRIEF DESCRIPTION OF THE DRAWINGS

FIG. 5 is a sectional view taken along the line 5—5 of FIG. 3.

FIG. 6 is an enlarged fragmentary sectional view taken along the line 6—6 of FIG. 5.

FIG. 7 is an enlarged fragmentary sectional view taken along the line 7—7 of FIG. 5.

FIG. 8 is an enlarged fragmentary sectional view taken along the line 8—8 of FIG. 5.

FIG. 9 is a fragmentary sectional view taken along the line 9—9 of FIG. 8.

DESCRIPTION OF THE PREFERRED EMBODIMENT

Figure 1:
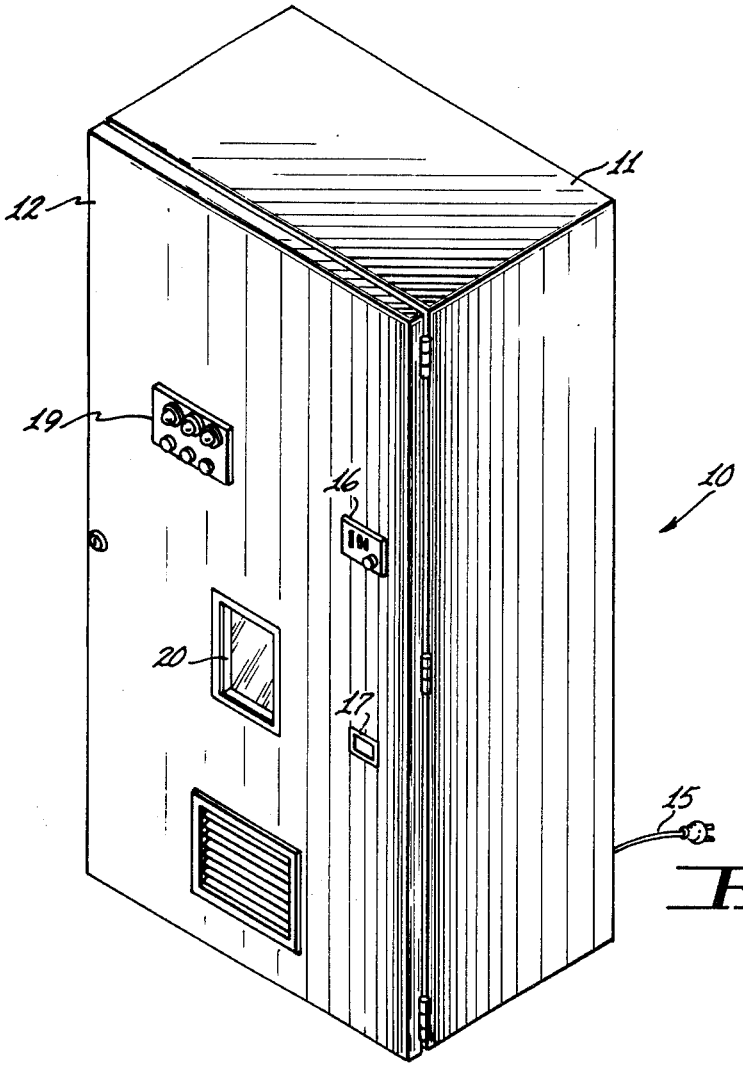
FIG. 1 is an isometric view of the exterior of the apparatus of the present invention.

Referring more particularly to the drawings, FIG. 1 illustrates the snow cone vending machine of the present invention which is indicated generally by the reference numeral 10. The vending machine 10 includes a conventional cabinet 11 having a door 12, opposed side walls 13 and 14 along with other structural elements and components common in such cabinets. The vending machine 10 also includes the usual electrical power cord 15 and a conventional coin deposit slot 16 and coin return chute 17, both of which are an integral part of a coin receiving mechanism 18 (FIG. 2) by which the operation of the machine 10 is enabled in the well known conventional manner. The door 12 of the cabinet 11 is also provided with a flavor selection panel 19 by which a consumer will select the particular flavored syrup to be applied to his snow cone. The door 12 of the cabinet 11 is configured so as to expose a product removal door 20, as will hereinafter be described in detail.

Figure 2:
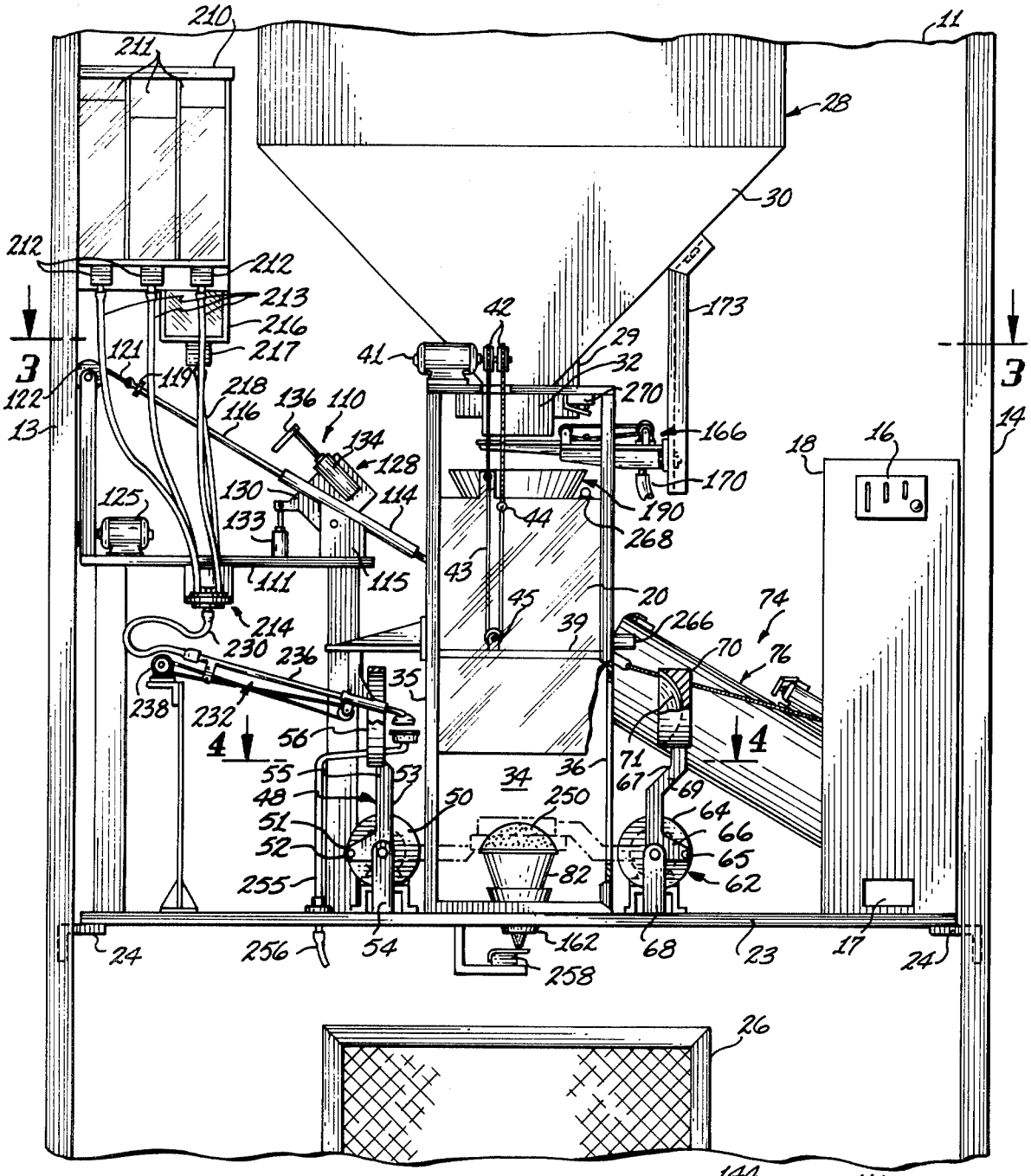
FIG. 2 is an enlarged fragmentary front elevational view showing the various internal mechanisms of the apparatus of the present invention.

As seen in FIG. 2, the cabinet 11 is divided into upper and lower compartments by a shelf 23 which is preferrably carried on a pair of tracks 24 mounted to the interior surfaces of the cabinet side walls 13 and 14, to allow the shelf 23 to be slidingly moved to facilitate servicing of the various equipment and devices supported thereon.

That portion of the cabinet below the shelf 23 is employed to house the usual refrigeration equipment 26 of the type commonly employed in flaked ice making machines. Such equipment is well known in the art to include mechanisms such as a compressor (not shown), condenser and fan (not shown), and the like. Due to the well known character and operation of the refrigeration equipment 26, it is deemed unnecessary to show that equipment in detail and to describe its operation.

In the upper end of cabinet 11, a conventional ice making machanism 28 is suitably mounted. The ice making mechanism 28 is provided with the usual freezing cylinder 29 (FIG. 2) mounted on the back wall (not shown) of an ice storage bin 30. The cylinder 29 is coupled to the refrigeration equipment 26 by suitable water and refrigerant lines (not shown), and is adapted to make ice in a flaked or comminuted form and compress it through a chute (not shown) into the storage bin 30. As will hereinafter be described in detail, the ice stored in the bin 30 is dispensed by a motor driven auger 31 (FIG. 10) which is horizontally disposed in the bottom of the storage bin 30. The auger 31, when actuated, will move the ice out of the bin 30 through a forwardly disposed downspout or mouth 32.

As seen best in FIGS. 2, 3, 4 and 5, a product preparation and dispensing compartment structure 34 is fixedly mounted atop the sliding shelf 23 at the forward central portion thereof. The dispensing compartment structure 34 is a substantially square upstanding structure having opposed side walls 35 and 36, a rear wall 37, with the vertically movable product removal door 20 acting as the front wall of the compartment. In addition, that portion of the shelf 23 which is enclosed by the compartment 34 serves as a compartment floor, and the compartment 34 also has an intermediate horizontally disposed platform or shelf 39 for supporting devices to be hereinafter described.

The product removal door 20 is supported in oppositely disposed side channels 40 (FIG. 4) carried on the front of the compartment structure and is vertically movable in those channels. The movement of the door 20 is accomplished by a reversible electric motor 41 carried atop the compartment structure 34. The motor 41 simultaneously drives a pair of drums 42 to which the opposite ends of a cord 43 are affixed so that as the drums are rotated, the cord will wind onto one drum and will be unwound from the other as determined by the rotational direction imparted thereto by the motor. The cord 43 is affixed such as at 44 to the door 20 and is operable through a pulley 45 carried on the platform 39 of the compartment 34. Thus, at the appropriate time in the sequence of operations of the machine 10, as will hereinafter be described, the door 20 is movable between its open and closed positions by means of the motor 41 and the other elements described above.

Figure 3:
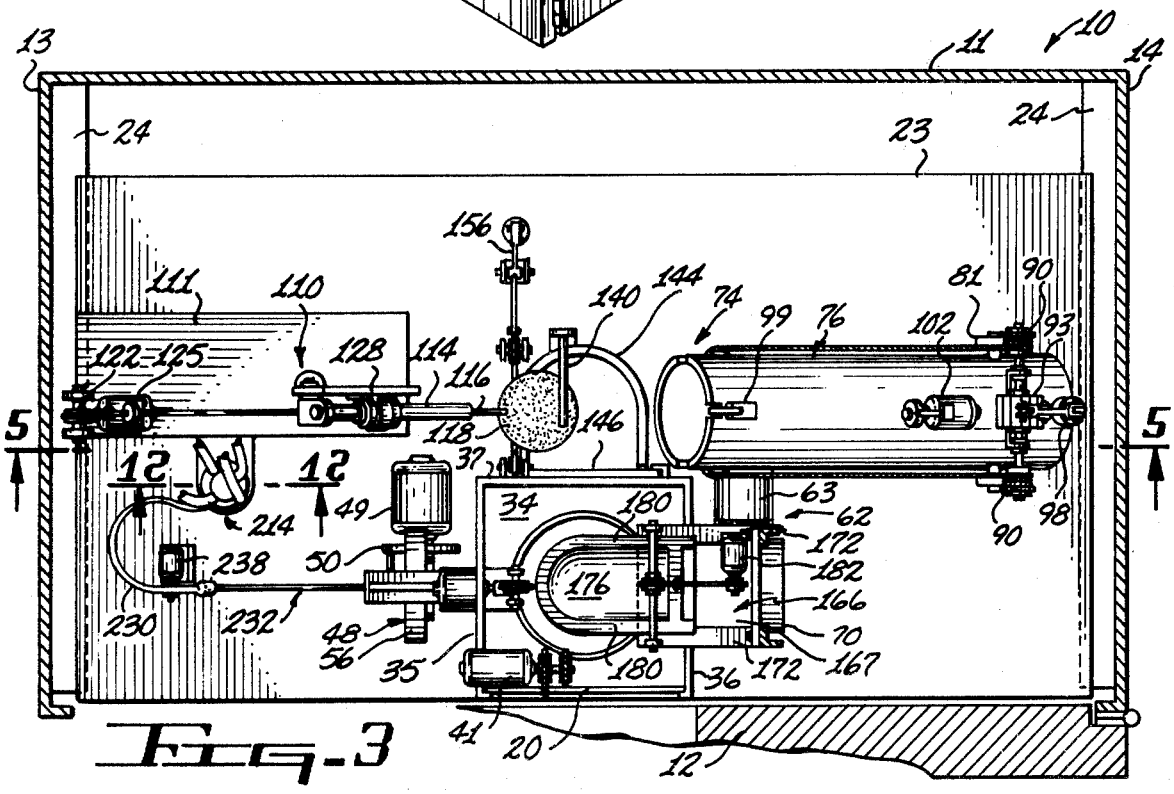
FIG. 3 is a sectional view taken along the line 3—3 of FIG. 2.
Figure 4:
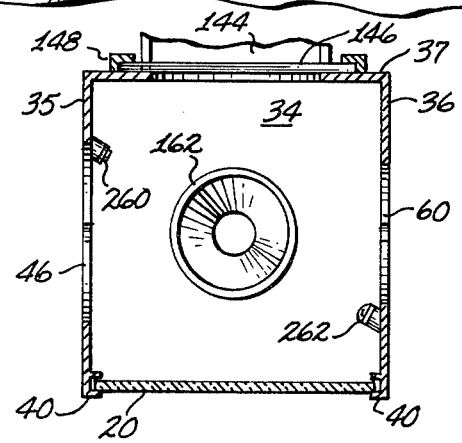
FIG. 4 is an enlarged fragmentary sectional view taken along the line 4—4 of FIG. 2.

As seen best in FIG. 4, the side wall 35 of the preparation and dispensing compartment 34 is formed with a keyhole shaped aperture 46 formed therethrough which allows access of a reciprocally operable collar assembly 48 to the interior of the compartment 34. The reciprocally operable collar assembly 48 is mounted on the shelf 23 laterally adjacent the side wall 35 of the compartment structure 34, and is seen in FIGS. 2 and 3 to include a reversibly drivable electric motor 49 for driving a disc 50 carried on the output shaft thereof. The disc 50 is provided with an eccentrically disposed pin 51 that is suitably connected to one arm 52 of a bell crank lever 53 that is pivotably carried in an upstanding clevis shaped fulcrum 54 mounted on the shelf 23. The other arm 55 of the bell crank lever 53 is provided with a cylindrically shaped structure having a bore formed therethrough to provide a collar 56 affixed to the extending end thereof. When the motor 49 is actuated, in the clockwise direction, as viewed in FIG. 2, the disc 50 is allowed to rotate through approximately 90° C., and this will move the collar 56 from its retracted position as shown in solid lines in FIG. 2 to its extended or operating position shown in phantom lines in that same Figure. It will be noted that the bore of the collar 56 has a circumference that is substantially equal to that of the snow cone cup, and the reason for which will become apparent as this description progresses. When the motor 49 is actuated in the reverse direction, the collar 46 will, of course, be returned from its extended position to the retracted position. For reasons which will hereinafter be described, it is preferred that the collar 56 be fabricated of optically clear material such as transparent plastic.

The opposite side wall 56 of the compartment structure 34 is also provided with a keyhole shaped aperture 60 (FIG. 4) formed therethrough which allows access of a reciprocally operable capper assembly 62 into the interior of the compartment 34. The capper assembly 62 is supported on the shelf 23 laterally adjacent the side wall 36 of the compartment structure 34, and is seen in FIGS. 2 and 3 to include a reversibly drivable electric motor 63 which is carried on the shelf 23 and which drives a disc 64 carried on the output shaft thereof. The disc 64 has an eccentrically disposed pin 65 mounted thereon which is suitably connected to one arm 66 of a bell crank lever 67. The bell crank lever 67 is pivotably mounted in a clevis shaped fulcrum 68 that is mounted on the shelf 23. The other arm 69 of the bell crank lever 67 has a capper 70 affixed to the extending end thereof. As shown, the capper 70 is a substantially cylindrical structure having a hemispherical cavity 71 formed in one of the planar surfaces thereof. The circular opening of the cavity 71 has a circumference which is substantially equal to the circumference of the rim of a snow cone cup, and the reason for which will become apparent as this description progresses. When the motor 63 is actuated in the counterclockwise direction, as viewed in FIG. 2, the disc will be rotated through approximately 90° and will thus move the capper 70 from its retracted position shown in solid lines in FIG. 2 to its extended or operative position shown in phantom lines in that same figure. The capper assembly 62 may, of course, be moved from its extended position to its retracted position by simply actuating the motor 63 in the reverse direction.

It should be noted that the configuration of the cavity 71 is hemispherical due to the fact that snow cones have traditionally been formed with a hemispherical dome. However, it will be noted that other cavity configurations could be employed. The purposes and operational sequences of the above described collar assembly 48 and capper assembly 62 will hereinafter be described in detail.

Reference is now particularly made to FIGS. 3, 5, 6 and 7 wherein a cup storage and delivery mechanism 74 is best shown. A cup storage tube assembly 76, which forms part of the mechanism 74, is supported on the sliding shelf 23 to the rear and right of the preparation and dispensing compartment 34. The storage tube assembly 76 includes an elongated cylindrical housing 77 having a bore 78 with a closed end 79 and an open mouth 80. For loading convenience, the housing 77 is pivotably carried in a clevis shaped fulcrum 81 so that the housing may be manually moved from its normal or operative position shown in solid lines in FIG. 5 to its loading position shown in phantom lines in the same Figure.

As is customary, snow cones are made and dispensed in cone shaped cups 82, and as shown in FIG. 7, a plurality of such cups are nestingly stacked with respect to each other and are placed within the bore 78 of the housing 77 so that the pointed end of the cup stack is circumscribingly engaged by a ring collar 84 that is coaxially disposed within the bore 78. The ring collar 84 is axially movable in the bore of the housing 77 to advance the cups 82 toward the mouth 80 of the housing. A pair of lines, or cords, 86 each have one of their ends 87 suitably affixed to diametrically opposed points on the ring shaped collar 84, and those cords 86 extend toward the mouth 80 of the housing 77, and pass oppositely through diametrically opposed axially extending slots 88 formed therein. The slots 88 each are formed with a rounded enlargement 89 in the bottom ends thereof so that the cords 86 will move smoothly through the slots 88 to the exterior of the housing 77 substantially axially toward the closed end 79 thereof. It should be understood that the smooth rounded enlargements 89 could be replaced with roller devices (not shown) which would operate in the same fashion and would reduce frictional drag on the cords. In any event, the cords 86 extend rearwardly and angularly upwardly from their respective slots 88 along opposite sides of the housing 77 and are each affixed to a different one of a pair of cord winding drums 90. The drums 90 are fixedly carried on opposite ends of a shaft 91 which is rotatably journaled in a clevis shaped bracket 92 mounted atop the housing 77 adjacent the closed end 79 thereof. Intermediate the opposite ends of the shaft 91, a ratchet gear 93 is fixedly mounted so that a pawl 94 which is freely suspendingly mounted on one end of a lever 95, will drivingly engage the ratchet gear. The lever 95 is pivotably carried in a clevis shaped fulcrum 96 and has its opposite end coupled to the plunger 97 of a normally retracted solenoid 98 that is suitably mounted on the housing 77. Each time the solenoid 98 is actuated, its plunger 97 will move to an extended position which causes pivotal movement of the lever 95 whereupon the suspendingly mounted pawl 94 will drive the ratchet gear 93 through one increment of its rotational movement. A single increment of rotational movement of the ratchet gear 93 is calculated to produce a predetermined amount of rotation of the cord winding drums 90 which in turn will result in pulling of the cords 86 an amount which will move the cup stack in a manner so that when a single cup 82 is removed from the housing 77, as will hereinafter be described, the next cup will be positioned in the location of the cup that has been removed.

Actuation of the solenoid 98 is accomplished by a cup position sensing switch 99 that is carried on the housing 77 adjacent the open mouth 80 thereof. The switch 99 is provided with a feeler 100 which is in contact with the lip or rim of the first cup 82 of the cup stack. When that first cup 82 is removed, the feeler 100 will drop and cause the switch 99 to close and apply power from a suitable source (not shown) to a stepping motor 102 mounted atop the housing 77. The stepping motor 102 is provided with a switch 103 that is equipped with a cam follower 104 that is in sliding engagement with the profile of a cam 105 which is drivingly rotated by the motor. When power is applied through the switch 99 to the motor 102 it will pass through the switch 103 which holds the motor in the operative state until one complete revolution of the cam 105 has been made, at which time the lobe 106 of the cam 105 will move the follower 104 to open the switch 103 and thus interrupt power to the motor. In addition to controlling the stepping function of the motor 102, the switch 103 will apply power during one revolution of the cam 105 to the solenoid 98 causing it to actuate the plunger 97 from its normally retracted position to its extended position.

Thus, it will be seen from the above description that the cup storage tube assembly 76 is a device which, in addition to simply storing the cups 82, will automatically and incrementally advance the cups so that there will always be one cup positioned within the bore 78 of the housing 77 immediately below the open mouth 80 thereof.

When the cylindrical housing 77 is in its normal, or operating position, as shown in FIG. 5, the longitudinal axis of the housing will be disposed, by means of a suitable stop bar 108 carried on the clevis fulcrum 81, at an angle of about 30° with respect to the horizontal. In this manner, the open mouth 80 of the housing 77 will be facing angularly and upwardly, and the weight of the cup stack will bear on the ring shaped collar 84 and will hold the cords 86 taut. When the housing 77 is manually moved to its upright or loading position, and a replacement cup stack is inserted therein, the weight of the cup stack will push the ring collar 84 toward the closed end 79 of the housing 77, and such movement can be accomplished by manually or otherwise disengaging the pawl, 94 from the teeth of the ratchet gear 93.

The cup storage and delivery mechanism 74 also includes a cup extraction means which is seen best in FIG. 5 and is indicated generally in that Figure by the reference numeral 110. The extraction means 110 is supported on a suitable platform 111 that is carried on the sliding shelf 23 and is located to the rear and left of the preparation and dispensing compartment 34. An elongated cylindrical sleeve 114 is mounted on an upstanding bracket 115 that is supported atop the platform 111, and that sleeve 114 is disposed to be in spaced axial alignment with the longitudinal axis of the cylindrical housing 77 in which the cups 82 are stored. An elongated rod 116 is slidably carried in the sleeve 114 and the rod is provided with a cup gripping means in the form of a ball 118 on one end thereof, and an eye 120 on its opposite end. A cord 121 is fixedly attached on one of its ends to the eye 120 on the rod 116, and passes over a pulley 122, which is mounted atop a standard 123 that is carried on the platform 111, and has its other end affixed to a cord winding drum 124 that is driven by a reversible motor 125 that is also supported on the platform 111. When the motor 125 is actuated to wind the cord 121, the cord will pull the rod 116 and its ball 118 to the retracted position shown in FIG. 5. When the motor 125 is actuated in the opposite direction, it will unwind the cord 121 from the cord winding drum 124 and gravity will move the rod 116 and the ball 118 into the open mouth 80 of the cup storage housing 77. When the ball 118 is thus moved, it will move into the open top of the uppermost cup 82. The ball 118 is formed of a suitable deformable resilient material such as sponge rubber, so that it will deform slightly upon entry into the top of the cup 82 and will frictionally grip the cup. The exterior of the ball 118 is preferrably textured to enhance the frictional engagement between the cup 82 and the ball.

To insure that the ball 118 will move with sufficient force to effect the desired frictional engagement thereof with the cup 82, a positive drive means 128 is employed to augment the gravitational forces which move the rod 116 toward the cup storage housing 77. The positive drive means 128 includes a plate 130 which is pivotably mounted on the upstanding bracket 115, and the plate 130 is provided with an arm 131 which is coupled to the plunger of a normally extending solenoid 133 that is fixedly carried on the platform 111. The plate 130 has a solenoid 134 mounted thereon which has a normally extending plunger with a shoe 136 affixed to its outermost end. When the rod 116 and ball 118 have moved by means of gravitational forces to place the ball 118 at the open top of the cup 82, the solenoid 133 is actuated to pivotably move the plate 130 and the solenoid 134 that is mounted thereon. In that position, the shoe 136 will move to a position immediately behind and adjacent the disc 119 that is provided on the rod 116 at the end thereof which is opposite to that on which the ball 118 is mounted. When in that position, the solenoid 134 is actuated so that the shoe 136 will move into engagement with the disc 119 and will thus positively drive the ball 118 into the open mouth of the uppermost cup 82. It will be understood that the above described means for reciprocally driving the rod 116 and ball 118 is but one way of accomplishing that function in that many well known driving mechanisms could be employed such as a driven rack gear arrangement (not shown).

Once this frictional engagement of the ball 118 with the cup 82 is accomplished, and the solenoids 133 and 134 have been deactuated, the motor 125 is actuated to effect a winding motion on the drum 124 and thus, retract the rod 116 and the ball 118 toward the retracted or starting positions thereof. Such retracting movements will carry the uppermost cup 82 out of the cup storage housing 77 and will move it into engagement with a cup dislodging pin 140 that is mounted on the upper end of a standard 141 carried on the shelf 23. The cup dislodging pin 140 is disposed in a manner so that the retracting ball 118 will miss the pin, but the rim of the cup 82 carried thereon, will move into contact with the pin 140 and will be dislodged from the ball thereby.

As seen best in FIG. 8, the cup dislodging pin 140 is disposed above a cup delivery chute 144 which is an upwardly opening structure that is mounted on the rear wall 37 of the preparation and dispensing chamber 34 so that the chute extends rearwardly therefrom. Thus, the cup 82 that is dislodged by the pin 140 will fall into the cup delivery chute 144 and will be retained therein by a rear door 146 that blocks an opening 147 formed in the back wall 37 at the lower end of the chute 144. The back door 146 is retained by and vertically movable in an oppositely disposed pair of guide channels 148 carried on the back wall 37 of the chamber 34. A suitable eye 149 is attached to the upper end of the door 146 and a cord 150 has one of its ends attached to that eye. The cord 150 extends upwardly from the eye 149 and passes over a pulley 151 that is mounted on the upper portion of the back wall 37 of the compartment 34. The cord 150 extends downwardly from the pulley 151 and passes over a spaced pair of pulleys 152 and 153, which are mounted on the sliding shelf 23, and has its opposite end suitably attached as at 154 to one end of a lever 156. The lever 156 is pivotably carried in a clevis shaped fulcrum 157 and the opposite end of the lever is suitably coupled to the end of a plunger 158 of a normally extending solenoid 160 that is fixedly mounted atop the sliding shelf 23. Therefore, at the proper time in the operational sequence of the vending machine 10, as will hereinafter be described, the rear door 146 will be moved upwardly by actuation of the solenoid 160, and will move from its downwardly disposed closed position shown in solid lines in FIG. 9, to its upwardly disposed or open position shown in phantom lines in that same Figure. Upon opening of the door 146, the cup 82, which has been retained in the chute 144 as previously described, will move under the influence of gravity through the opening 147 in the back wall 37 and will enter into the preparation and dispensing chamber 34, where it will be received in a cup retaining structure 162 (FIG. 2). As seen in FIG. 2, the cup retainer 162 may be formed of an inverted hollow frustro-conical configuration which is mounted in the floor of the compartment 34.

As hereinbefore described, flaked ice is dispensed through the downspout 32 from a conventional flaked ice making machine 28 located in the upper portion of the cabinet 11. As will become apparent as this description progresses, it is important that the quantity of dispensed ice be accurately controlled and that when the dispensing operation is completed, no more ice or water drops be allowed to fall into the preparation and dispensing compartment 34. Therefore, as seen best in FIGS. 2, 3, and 10, the conventional flaked ice making machine 28 has been equipped with a drip catching means which is indicated generally by the reference numeral 166.

The drip catching means 166 includes a fixed tray 167 which is an elongated upwardly opening pan shaped structure having one open end 168 and a bottom wall 169 which slopes downwardly therefrom toward the opposite closed end, with the bottom 169 having a drain pipe 170 extending from the lowermost end thereof. The fixed tray is formed with an opposed pair of upstanding side walls 171 each of which is flared outwardly along its upper edge to form a pair of guide rails or tracks 172. The fixed tray 167 is mounted on a bracket 173 which is dependingly affixed to the ice storage bin 30, and the tray 167 extends normally from the bracket 173 so that its open end 168 is laterally adjacent the opening from the downspout 32, and is disposed somewhat below that opening.

The drip catching means 166 also includes a movable tray 176 which is an elongated pan shaped structure that is open on one end 177 and closed on its opposite end 178, and is provided with a bottom 179 which slopes angularly downwardly from the closed end 178 toward the open end 177. The movable tray 176 is provided with an opposed pair of upstanding side walls each of which is flared outwardly along its upper edge to provide a pair of oppositely extending flanges 180.

The movable tray 176 is nestingly positioned in the fixed tray 167 so that the flanges 180 of the movable tray rest on the guide rails 172 of the fixed tray, and the movable tray is oriented so that the closed end 178 thereof protrudes from the open end of the fixed tray.

The drip catching means 166 further includes means for reciprocally moving the movable tray 176 relative to the fixed tray 167, and that means preferrably includes a reversible electric motor 182 which drives a pulley 183 fixedly carried on its output shaft. The motor 182 is mounted atop the fixed tray 167 adjacent its closed end, and has an endless cord 184 passing over the pulley 183 thereof. The cord 184 extends from the pulley 183, is affixed as at 185 to the movable tray 176, and passes over another pulley 186 that is mounted to the fixed tray 167 adjacent the open end 168 thereof.

Figure 10:
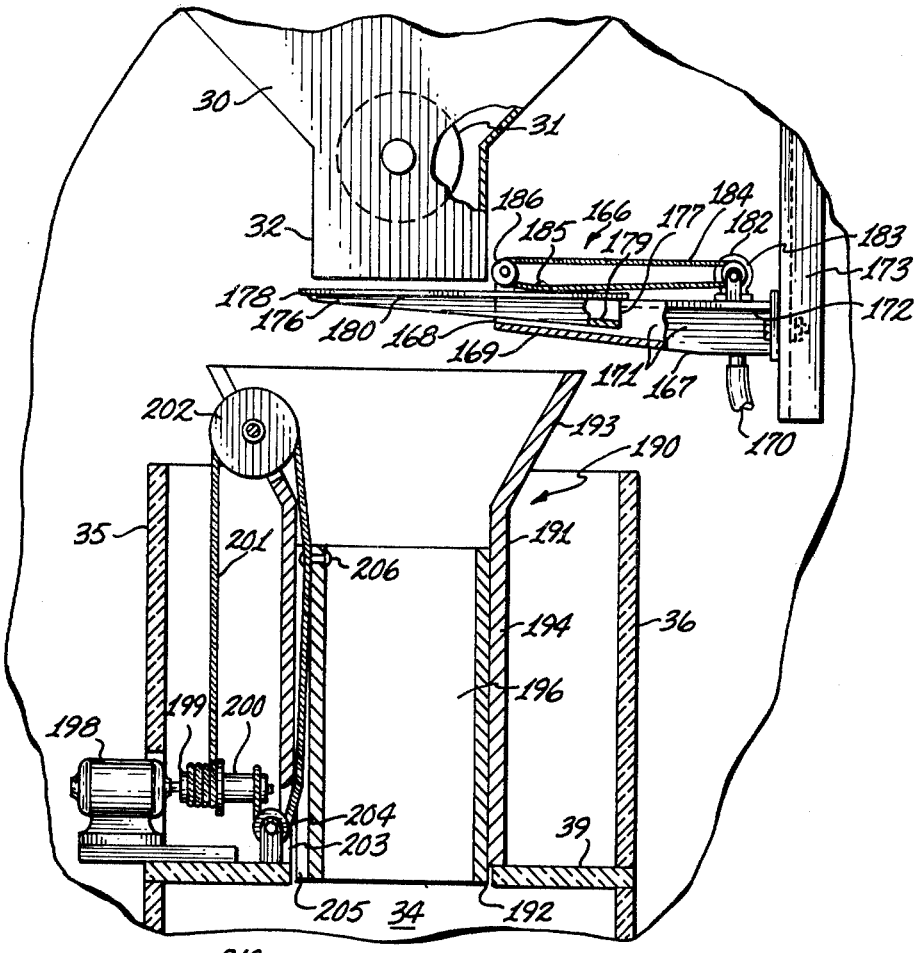
FIG. 10 is a fragmentary front elevational view of the flaked ice delivery mechanism of the apparatus of the present invention.

The drip catching means 166 is considered to be in its extended position as shown in FIG. 10, when the closed end of the movable tray 176 is disposed below the downspout 32 of the ice making machine 28, and in that extended position, any ice or water falling from the downspout will be caught in the moving tray and will migrate into the fixed tray and be passed therefrom to a suitable disposal point (not shown) through the drain pipe 170. To retract the drip catching means 166, the electric motor 182 is simply energized, in the counterclockwise direction as viewed in FIG. 10, and the endless cord 184 will slidingly move the movable tray 176 along the guide rails 172 of the fixed tray 167. For simplified control purposes, it is preferred that the motor 182 be wired to the motor (not shown) which drives the auger 31 so that when the auger 31 is turned on, the drip catching means will automatically move to its retracted position, and when the auger is switched off, the drip catching mechanism will move to its extended position.

An ice delivery mechanism 190 is provided in the upper portion of the preparation and dispensing chamber 34, and as seen best in FIG. 10, is disposed immediately below the downspout 32 of the ice making machine 28. The ice delivery mechanism 190 includes a funnel 191 which is mounted on the intermediate shelf or platform 39 of the compartment structure 34, and is upstanding therefrom and is in alignment with a central aperture 192 formed through that shelf 39. The funnel 191 is provided with an upwardly disposed outwardly flared portion 193 from which a cylindrical tubular barrel portion 194 depends. A sleeve 196 is telescopically reciprocally mounted within the bore of the funnel's barrel 194, and is movable from the upwardly disposed, or retracted, position shown in FIG. 10, to a downwardly extending position (not shown) within the preparation and delivery compartment 34. The ice delivery mechanism 190 further includes means for reciprocally moving the sleeve 196 between its retracted and extended positions, and that means is seen to include a reversible electric motor 198, which is suitably mounted on the intermediate platform 39. The motor 198 has a pair of cord winding drums 199 and 200 mounted on its output shaft and the opposite ends of a cord 201 are each affixed to a different one of those drums and are wrapped oppositely around their respective drums. The cord 201 extends upwardly from the drum 199 and passes over a pulley 202 that is mounted in the flared portion 193 of the funnel 191 and passes downwardly through the funnel and exits therefrom through a slot 203 which is formed in the lower portion of the barrel 194. A pulley 204 is mounted on the intermediate shelf 39 adjacent the slot 203 and the cord 201 passes over that pulley upon exiting from the funnel 191 and is affixed to the other drum 200. The reciprocal sleeve 196 is provided with a longitudinally extending channel 205 formed in the side thereof and the cord 201 lies in that channel 205 and is affixed to the sleeve such as with a rivet 206.

At the appropriate time in the operating sequence of the machine 10, as will hereinafter be described, the ice delivery mechanism 190 is actuated by operating the motor 198 to cause the reciprocal sleeve 196 to move to its extended position, which locates the downwardly disposed end thereof immediately above the open end of a cup 82 which has been delivered to the compartment 34 as previously described. Thus, ice dispensed from the downspout 32 of the ice making machine 28 will be directed downwardly through the funnel 191 and extended sleeve 196 and be deposited into the cup. When the ice is thus deposited, the motor 198 is actuated in the reverse direction to move the sleeve 196 back to its retracted position.

As shown in FIG. 2, the snow cone vending machine 10 of the present invention is provided with a flavored syrup reservoir 210 in the upper portion of the cabinet 11. The reservoir 210 is provided with a plurality of individual compartments 211 for containing a plurality of syrup flavors, and each compartment is provided with a solenoid shutoff valve 212 on its lower end. The solenoid valves 212 are in communication with the interiors of their respective compartments 211, and each have a hose 213 coupled to the outlet thereof. The outlet hoses 213 extend downwardly from their respective solenoid valves 212 and are connected to a syrup retaining bowl assembly 214.

The syrup reservoir 210 has a water compartment structure 216 dependingly affixed to the bottom thereof, and the water compartment 216 has a solenoid shutoff valve 217 which communicates with the interior thereof and has an outlet hose 218 which leads from the solenoid valve 217 to the syrup retaining bowl assembly 214.

The solenoid valves 212 coupled to the syrup compartments 211 are under control of the individual buttons of the flavor selection panel 19 provided on the exterior of the cabinet 11 so that the purchaser of a snow cone by pressing the button of his choice will energize the appropriate one of the solenoid valves 212 to dispense a predetermined amount of syrup into the syrup retaining bowl assembly 214. As will hereinafter be described, the solenoid valve 217 of the water compartment 216 is controlled by the timing and control equipment (not shown) of the machine 10 to deliver a predetermined amount of water to the syrup retaining bowl assembly 214 at the proper time for flushing purposes.

Figure 12:
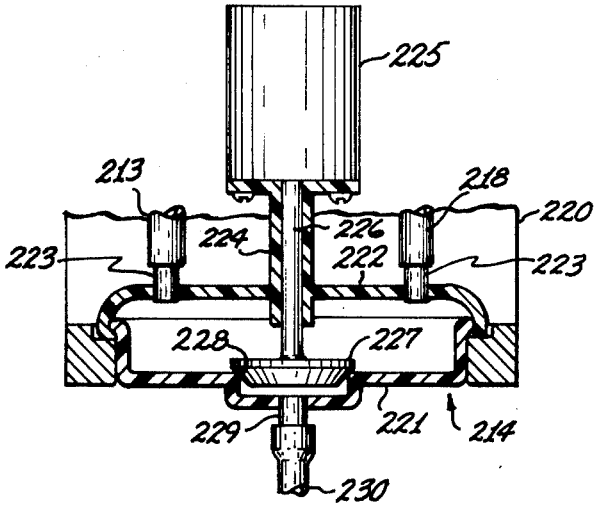
FIG. 12 is an enlarged fragmentary sectional view taken along the line 12—12 of FIG. 3.

The syrup retaining bowl assembly 214 is mounted to the platform 111 by a bracket 220, and as shown in FIG. 12, the bowl assembly 214 comprises a base cup 221 to which a cover 222 is demountably attached. The cover 222 is provided with a plurality of peripherally disposed upstanding bosses 223 to which the hoses 213 and 218 are coupled so that the syrup flavors and water can be delivered into the interior of the bowl 214. The cover 222 is also provided with a central boss 224 on the uppermost end of which a solenoid 225 is mounted so that the plunger 226 of the solenoid extends downwardly through that boss 224. The solenoid 225 is a normally extending device and the plunger 226 thereof has a shutoff or poppet valve 227 on its lower end which is normally held in engagement with a valve seat 228 formed in the base cup 221. The base cup 221 is formed with a centrally depending boss 229 to which a flexible outlet hose 230 is coupled.

The syrup flavor or water delivered to the syrup retaining bowl assembly 214 will be received in the interior thereof and will be retained therein until the solenoid 225 is energized to lift the poppet valve 227 off of the seat 228, at which time the contents of the bowl 214 will flow under the influence of gravity into the flexible outlet hose 230.

Figure 11:
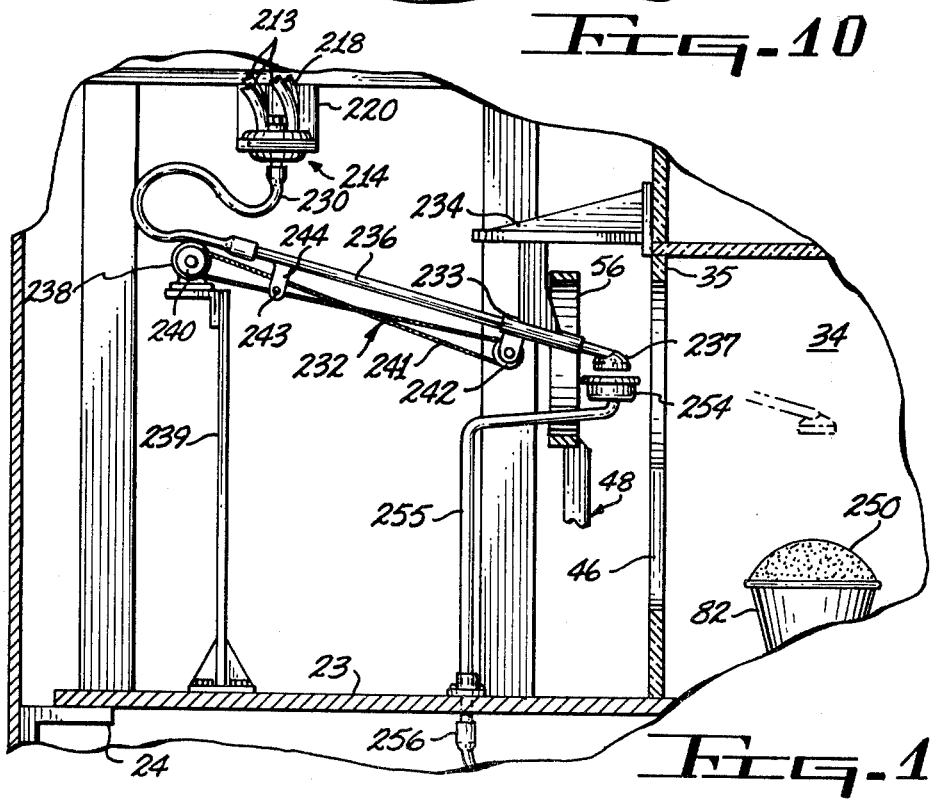
FIG. 11 is a fragmentary front elevational view of the flavored syrup delivery and application mechanism of the apparatus of the present invention.

Referring now in particular in FIG. 11 wherein a syrup delivery means 232 is best seen. The means 232 includes a tubular sleeve 233 which is rigidly supported by a bracket extendingly mounted on the side wall 35 of the preparation and dispensing compartment structure 34. An elongated tube 236 is axially slidingly mounted in the sleeve 233, and the tube 236 is formed with a dispensing head 237 on one end and has the flexible outlet hose 230, which leads from the syrup retaining bowl 214, coupled to its other end. The elongated tube 236 is reciprocally movable in the sleeve 233 from its retracted position shown in solid lines in FIG. 11 to its extended position shown in phantom lines in that same figure.

To accomplish the reciprocal movement of the elongated tube 236, a reversible electric motor 238 is mounted atop a standard 239 that is mounted on the intermediate shelf 23. The motor 238 reversibly drives a pulley 240 that is carried on its output shaft and an endless cord 241 passes over that pulley 240 and another pulley 242 which is carried on the tubular sleeve 223. The endless cord 241 is affixed as at 243 to a lug 244 that is formed on the elongated tube 236.

When the electric motor 238 is actuated to rotate in the clockwise direction as viewed in FIG. 11, the elongated tube 236 will move from its retracted position, through the keyhole shaped aperture 46 formed in the side wall 35 of the compartment structure 34, to a position where the dispensing head 237 is located immediately above the location where a snow cone 250 is being prepared for dispensing. After the flavoring syrup is dispensed into the snow cone 250, the elongated tube 236 is retracted by simply actuating the electric motor 238 in the opposite direction.

When the elongated tube 236 is in its retracted position, the dispensing head 237 is disposed immediately above a sink structure 254 which is carried atop a rigid drain pipe 255. The drain pipe is suitably mounted on the intermediate shelf 23 and passes through that shelf and has a drain hose 256 coupled to the depending end thereof. The sink structure 254 is employed to receive the flushing water which is directed from the water reservoir compartment 216 through the syrup retaining bowl assembly 214, through the flexible hose 230, through the elongated tube 236, out of the dispensing head 237 and into the sink from which it is directed to a suitable disposal point (not shown). In this manner, the syrup retaining bowl assembly 214 and the syrup delivery means 232 are purged after each delivery of syrup to prevent residual amounts of syrup used in the making of a particularly flavored snow cone from tainting the flavor of a subsequentially made snow cone.

OPERATION

Operation of the snow cone vending machine 10 as previously described, is enabled by a purchaser depositing the proper coin or combination of coins into the coin box 18 which applies electrical power to the various components of the machine 10. It should be noted that the single exception to this enabling of the electrical power is the refrigeration equipment 26 and the ice making machine 28 which receive power continuously in order to maintain a ready state of the flaked ice.

When the machine 10 is enabled by deposition of a coin, the sequence of operations, now to be described, is initiated when a purchaser presses the flavor selection button of his choice on the flavor selection panel 19. Depression of a particular flavor button will energize the appropriate one of the solenoids 212 to effect delivery of a predetermined amount of the selected syrup to the syrup retaining bowl assembly 214. The amount of syrup delivered to the bowl assembly 214 is controlled by a suitable timing device (not shown) which holds the selected solenoid 212 in its actuated state for a predetermined length of time.

In addition to causing delivery of the selected syrup flavoring, depression of a button on the panel 19 will simultaneously cause the rear door 146 of the preparation and dispensing compartment 34 to be opened, and upon opening, a cup 82 which was previously deposited in the chute 144 will drop from the chute into position within the cup retaining structure 162. The rear door 146 is timed in its opening and closing operations by a suitable timing device (not shown).

Further, in addition to causing delivery of syrup to the bowl assembly 214, and causing a snow cone cup to be delivered to the cup retaining structure 162, depression of a button on the flavor selection panel 19 will simultaneously initiate operation of the snow cone cup extracting means 110 which will effect removal of a snow cone cup 82 from the cup storage and delivery mechanism 74, and will deposit that extracted cup 82 into the chute 144 where it will be retained for subsequent use by the rear door 146 which will have returned to its closed position by the time the replacement cup 82 is deposited in the chute.

When the cup 82 falls into the cup retaining structure 162, its lowermost point will protrude therethrough and will contact a switch 258 which, as seen in FIG. 2, is mounted immediately below the cup retaining structure 162, and will cause that switch to close.

Figure 13A:
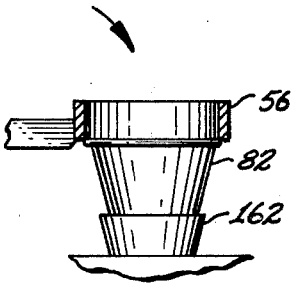
FIGS. 13*a* through 13*e* are diagrammatic views which illustrate the various operations and steps of the method and apparatus of the present invention.

When the switch 258 is closed, it will apply power to effect pivotal movement of the ice catching and retaining collar 56 to its extended position, which, as best seen in FIG. 13*a* will place that collar 56 so that it circumscribes the lip of the cup 82 and extends upwardly therefrom.

Also, the switch 258, when closed, will simultaneously cause the drip catching means 166 to move to its retracted position, and through a suitable time delay device (not shown) will cause the sleeve 196 of the ice delivery means 190 to telescopically extend downwardly into the compartment 34 to a position immediately above the ice retaining collar 56 and the snow cone 82 held in the cup retaining structure 162.

Figure 13B:
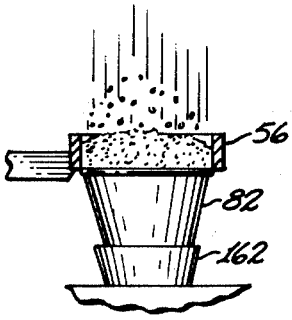

The switch 258, when closed, will also apply power to the auger 31 of the ice making machine 28 and thus cause flaked ice to be dispensed from the downspout 32 through the ice delivery means 190 into the cup 82. As seen in FIG. 13*b* the ice deposited in the cup 82 is allowed to fill the cup and to pile up in the ice collecting and retaining collar 56. The flaked ice will continue to be dispensed until it piles up to a predetermined level within the collar 56 at which time it will interrupt a light beam that is being emitted by a suitable light emitting device 260 so as to pass through the optically clear collar and impinge on a light responsive device 262 which are seen in FIG. 4 to be mounted on opposing side walls 35 and 36 of the compartment structure 34.

When the light beam produced by the light emitting device 260 is interrupted by the ice having piled up within the collar 56, the light responsive device 262 will respond by simultaneously shutting off the auger 31, moving the drip catcher means 166 to its extended position, and retracting the sleeve 196 of the ice delivery means 190.

Figure 13C:
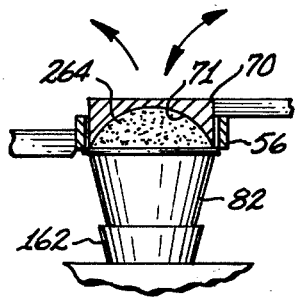

When the sleeve 196 of the ice delivery means 190 reaches its retracted position, it will contact a switch (not shown) which applies power to the motor 63 of the capper assembly 62 causing it to pivot to its extended position which, as seen best in FIG. 13*c*, will move the capper 70 to a position atop the ice in the cup 82 and will shape the ice into a hemispherical dome 264 atop the cup 82. The capper assembly 62, after having been moved to the above described extended position, will by means of a suitable timing device, (not shown) be actuated by a suitable switch (not shown) that causes it to move back to its retracted position, and that same switch (not shown) will cause the ice catching and retaining collar to also be moved to its retracted position. That same switch (not shown) will simultaneously apply power to the electric motor 238 which causes the elongated tube 236 of the syrup delivery means 232 to move to its extended position above the ice dome 264 in the cup 82 as seen in FIG. 13*d*.

Figure 13D:
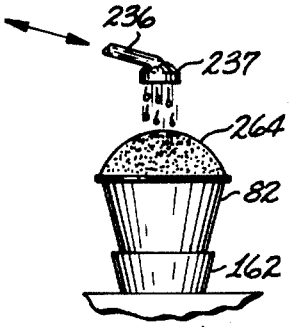

When the extending movement of the elongated tube 236 is initiated as described above, a suitable time delay device (not shown) is set into operation, and after a predetermined length of time, that delay device will actuate a suitable switch (not shown) which in turn energizes the solenoid 225 of the syrup retaining bowl assembly 214 thus allowing the syrup, which was previously deposited into the bowl, to flow through the extended syrup delivery means 232 and out the dispensing head 237 into the ice dome 264 as shown in FIG. 13*d*.

The switch (not shown) which energized the solenoid 225 as described above, also initiates operation of another suitable timing device (not shown) which, after the expiration of a predetermined time, will cause the elongated tube 236 of the syrup delivery means 232 to move back to its retracted position and will cause a door locking solenoid 266 (FIG. 2) to be deenergized so as to retract its plunger (not shown) which was, up until this time holding the product removal door 20 in the locked position. The door locking solenoid 266 is a normally retracted device, i.e., its plunger (not shown) is normally retracted, and the solenoid is energized to lock the door 20 upon the deposition of a coin into the coin box 18, as described at the beginning of this description of operation of the machine 10.

Figure 13E:
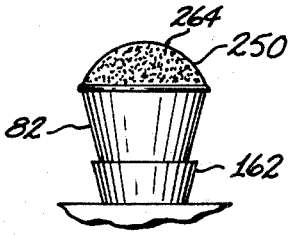

As shown in FIG. 13*e*, the completed snow cone 250 is now ready for dispensing and simultaneously with the deenergizing of the door locking solenoid 266, the electric motor 41 is energized to raise the product delivery door 20 and the completed snow cone 250 can then be removed by the purchaser. When the door 20 is opened as described above, a pin 268 (FIG. 2) mounted atop the door 20 will move into contact with a switch 270 mounted on the upper part of the compartment 34. When the switch 270 is closed by virtue of the pin 268 having moved into engagement therewith, the motor 41 is reversed thereby closing the door 20. The switch 270 also energizes the solenoid 217 of the water reservoir compartment 216 and energizes the solenoid 225 of the syrup retaining bowl 214 to allow flushing of the syrup handling devices as previously described. Those solenoids 217, and 225 are held in the energized position for a predetermined length of time by a suitable timing device (not shown) which first deenergizes the solenoid 217, then deenergizes the solenoid 225 and then shuts off the power to the machine 10 with the exception of the ice making components as described above.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A machine for making snow cones comprising:

(a) a cabinet;

(b) a compartment in said cabinet, said compartment having a cup retaining structure upstandingly mounted therein;

(c) cup delivery means in said cabinet adjacent said compartment for delivering a cup to the cup retaining structure in said compartment;

(d) a collar means for collecting and retaining ice mounted in said cabinet adjacent said compartment, said collar means reciprocally movable into said compartment to a position which upstandingly circumscribes the rim of the cup when delivered thereinto;

(e) on ice making machine in said cabinet;

(f) an ice delivery mechanism in said cabinet adjacent said ice making machine and reciprocally movable into said compartment for delivering ice from said ice making machine into the cup when delivered thereto and into said collar means when circumscribingly positioned relative thereto;

(g) a capper means mounted in said cabinet adjacent said compartment and reciprocally movable into said compartment to a position above said cup retaining structure so that when ice is deposited in the cup and in said collar means, said capper means will form the ice into a dome configuration extending above the rim of the cup;

(h) a reservoir for containing flavored syrup in said cabinet; and (i) syrup delivery means mounted in said cabinet and coupled to said reservoir, said syrup delivery means reciprocally movable into said compartment above the cup retaining structure, said syrup delivery means actuatable to deposit a predetermined amount of flavored syrup onto the dome of ice when formed on the cup.

2. A machine for making snow cones as claimed in claim 1 wherein said cup delivery means comprises:

(a) an elongated tube having an open mouth, said tube for containing a stacked plurality of cups with the open ends thereof facing the mouth of said tube with the outermost one of the cups disposed adjacent the open mouth of said tube;

(b) a cup extraction means spaced from the open mouth of said tube and in axial alignment therewith, said cup extraction means reciprocally movable toward and away from the mouth of said tube so that when the stack of cups is disposed in said tube, movement of said cup extraction means toward the mouth of said tube will bring said cup extraction means into frictional gripping engagement with the outermost one of the stack of cups and movement away from the mouth of said tube will extract that frictionally gripped cup therefrom; and (c) cup dislodging means adjacent the path of reciprocal movement of said cup extraction means for dislodging the frictionally gripping cup from said cup extraction means when said cup extraction means is moved away from said tube and has the outermost one of the cups frictionally gripped thereby.

3. A machine for making snow cones as claimed in claim 2 and further comprising means on said tube and in engagement with the stack of cups when the stack of cups is disposed in said tube for incrementally advancing the stack of cups toward the open mouth of said tube each time a cup is extracted therefrom so that the place vacated by the extracted cup is filled by the next cup in the stack of cups.

4. A machine for making snow cones as claimed in claim 1 wherein said cup delivery means comprises:

(a) an elongated tube having an open mouth;

(b) a ring collar coaxially disposed in said tube and movable along the longitudinal axis thereof;

(c) a stacked plurality of cups in said tube with the innermost end of said stack in engagement with said ring collar for movement therewith, said stack of cups having the open ends thereof facing the mouth of said tube and having the outermost cup of said stack disposed adjacent the mouth of said tube;

(d) an elongated sleeve in axial alignment with said tube and spaced outwardly from the mouth thereof;

(e) an elongated rod slidably mounted in said sleeve;

(f) means coupled to the one end of said rod which is furthest away from said tube for reciprocally moving said rod toward and away from said tube;

(g) a deformable resilient ball on the other end of said rod for movement into the outermost cup of said stack to frictionally grip that cup when said rod is moved toward said tube and to extract that cup when said rod is moved away from said tube;

(h) a cup dislodging means adjacent the reciprocal movement path of said rod and said ball for dislodging the frictionally gripped cup from said ball when said rod and said ball are moved away from said tube;

(i) means on said tube and coupled to said ring collar for incrementally advancing said stack of cups toward the mouth of said tube each time a cup is extracted therefrom to move the next cup in said stack into the location vacated by the extracted cup.

5. A machine for making snow cones as claimed in claim 1 wherein said collar means comprises a cylindrically shaped structure having a bore formed therethrough with the bore having a circumference which substantially matches the circumference of the rim of the cup which is deliverable to the cup retaining structure in said compartment.

6. A machine for making snow cones as claimed in claim 5 wherein said collar means further comprises:

(a) means coupled to said cylindrically shaped structure for pivotably mouting said cylindrically shaped structure adjacent said compartment; and (b) means coupled to said cylindrically shaped structure for pivotably reciprocally moving said cylindrically shaped structure into and out of said compartment.

7. A machine for making snow cones as claimed in claim 1 wherein said ice delivery mechanism comprises:

(a) a funnel fixedly mounted on said compartment, said funnel having a tubular barrel portion;

(b) a sleeve telescopically mounted in the tubular barrel portion of said funnel and reciprocally movable therein between an extended position within said compartment and a retracted position external of said compartment; and (c) means coupled to said sleeve for reciprocally moving said sleeve.

8. A machine for making snow cones as claimed in claim 1 wherein said capper means comprises a structure having at least one planar surface with a hemispherical cavity formed in that planar surface with the circular opening of said hemispherical cavity having a circumference which substantially matches the circumference of the rim of the cup which is deliverable into the cup retaining structure in said compartment.

9. A machine for making snow cones as claimed in claim 8 wherein said capper means further comprises:
(a) means coupled to said structure for pivotably mounting said structure adjacent said compartment; and
(b) means coupled to said structure for pivotably reciprocally moving said structure into and out of said compartment.

10. A machine for making snow cones as claimed in claim 1 wherein said reservoir comprises:
(a) a container having multiple compartments formed therein, each of said compartments for containing a differently flavored syrup and each having an outlet;
(b) each of the compartments of said container having a different solenoid valve connected to its outlet for controlling the outflow of syrup therefrom; and
(c) each of said solenoids having a different hose connected thereto with said hoses coupled to said syrup delivery means.

11. A machine for making snow cones as claimed in claim 1 wherein said syrup delivery means comprises:
(a) a syrup retaining bowl coupled to receive flavored syrup from said reservoir, said syrup retaining bowl having an outlet boss;
(b) shutoff valve means in said syrup retaining bowl for retaining the received syrup when said shutoff valve means is closed and for releasing the received syrup when said shutoff valve means is opened;
(c) a flexible hose having one of its ends coupled to the outlet boss of said syrup retaining bowl;
(d) an elongated sleeve mounted in said cabinet adjacent said compartment;
(e) an elongated tube mounted in said sleeve and reciprocally slidable in said sleeve between an extended position within said compartment and a retracted position external of said compartment;
(f) said flexible hose having its other end coupled to one end of said elongated tube;
(g) a syrup dispensing head on the opposite end of said elongated tube; and
(h) means coupled to said elongated tube for reciprocally moving said tube between its extended and retracted positions.

12. A machine for making snow cones as claimed in claim 11 and further comprising:
(a) a water compartment mounted in said cabinet, said water compartment having an outlet;
(b) a solenoid valve coupled to the outlet of said water compartment for controlling the outflow of water therefrom; and
(c) a hose having one of its ends coupled to said solenoid valve and having its other end coupled to said syrup retaining bowl so that water from said water compartment can be directed through said syrup retaining bowl, through said flexible hose, through said elongated tube and out of said syrup dispensing head for flushing purposes.

13. A machine for making snow cones as claimed in claim 1 and further comprising drip catching means mounted in said cabinet and retractably interposable between said ice making machine and said ice delivery means for catching ice and water drops from said ice making machine when said drip catching means is interposed between said ice making machine and said ice delivery means and directing the caught ice and water drops to a disposal point.

14. A method of making snow cones comprising the steps of:
(a) placing a snow cone cup in an upright position;
(b) placing a ring shaped collar in upstanding engagement on the rim of said snow cone cup with said collar circumscribing the opening of said snow cone cup;
(c) depositing flaked ice in said snow cone cup and in said ring shaped collar so that said flaked ice is piled up above the rim of said snow cone cup;
(d) shaping said piled up ice into a crown atop said snow cone cup by placing a capper structure having a cavity formed therein on top of said piled up ice;
(e) removing said capper structure and said ring shaped collar; and
(f) applying a flavored syrup on the crowned ice atop said snow cone cup to complete making of said snow cone.

15. A cup dispensing mechanism comprising:
(a) an elongated tube having an open mouth, said tube for containing a stack of cups in a position with the open ends of the cups facing the mouth of said tube and with the first cup in the stack disposed adjacent the mouth of said tube;
(b) a cup extraction means having a cup gripping means thereon, said cup extraction means spaced from said tube and in axial alignment with the open mouth thereof, said cup extraction means reciprocally movable toward and away from the open mouth of said tube so that when the stack of cups is disposed in said tube, movement of said cup extraction means toward the mouth of said tube will move the cup gripping means into frictional gripping engagement with the first cup in the stack of cups and movement away from the mouth of said tube will extract the first cup therefrom;
(c) cup dislodging means adjacent the path of reciprocal movement of said cup extraction means for dislodging the frictionally gripped cup from the cup gripping means when said cup extraction means is moved away from the mouth of said tube and when the first cup of the stack of cups is gripped by the cup gripping means; and
(d) means mounted on said tube and in engagement with the stack of cups when those cups are contained in said tube for holding and advancing the stack of cups toward the open mouth of said tube when the first cup is extracted by said cup extraction means so that the place vacated by the first cup is filled by the next cup in the stack of cups, said means including,
I. a ring shaped collar slidably movably mounted in said elongated tube,
II. a pair of cords each affixed to a different diametrically opposed point on said collar and extending through the open mouth of said tube and back along the periphery of said tube,
III. a pair of cord winding drums rotatably mounted on the periphery of said tube, each of said pair of drums having a different one of said pair of cords windingly attached thereto,
IV. drive means coupled to rotatably drive said pair of cord winding drums, said drive means adapted to rotate said drums less than one revolution at each actuation thereof,
V. sensing means mounted adjacent the open mouth of said tube for detecting the absence of a cup at that location and responding by producing an output signal, and VI. a stepping motor mounted on the exterior of said tube, said stepping motor coupled to receive the output signal from said sensing means and responding thereto by actuating said drive means.

16. A cup dispensing mechanism as claimed in claim 15 wherein said cup extraction means comprises:

(a) an elongated sleeve in axial alignment with said elongated tube and spaced from the open mouth thereof;

(b) an elongated rod slidably mounted in said sleeve;

(c) means coupled to the end of said rod which is furthest from the open mouth of said tube for reciprocally slidingly moving said rod in said sleeve; and (d) said rod having the cup gripping means of said cup extraction means mounted on the other end thereof.

17. A cup dispensing mechanism as claimed in claim 15 wherein the cup gripping means of said cup extraction means comprises a deformable resilient ball.

18. A cup dispensing mechanism as claimed in claim 15 wherein said cup dislodging means comprises a pin mounted transverse with respect to the path of reciprocal movement of said cup extraction means and in a position to strike the rim of the first cup when that cup is frictionally gripped by the cup gripping means of said cup extraction means.

* * * * *